US007578701B2

(12) United States Patent
Hsu

(10) Patent No.: US 7,578,701 B2
(45) Date of Patent: Aug. 25, 2009

(54) ELECTRICAL CONNECTOR HAVING FLEXIBLY AND STEADILY ENGAGEMENT BETWEEN METALLIC SHELLS AND GROUNDING TERMINALS

(75) Inventor: Kuo-Chun Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/316,222

(22) Filed: Dec. 10, 2008

(65) Prior Publication Data

US 2009/0149042 A1 Jun. 11, 2009

(30) Foreign Application Priority Data

Dec. 10, 2007 (TW) ..... 96220888 U

(51) Int. Cl.
*H01R 13/648* (2006.01)

(52) U.S. Cl. ..... 439/607.34

(58) Field of Classification Search ..... 439/607.34, 439/83, 607.28, 607.31, 108, 74, 101
See application file for complete search history.

(56) References Cited

U.S. PATENT DOCUMENTS

| | | | | |
|---|---|---|---|---|
| 5,915,976 | A | 6/1999 | McHugh | |
| 6,179,626 | B1 * | 1/2001 | Wu | 439/74 |
| 6,227,874 | B1 * | 5/2001 | Yu | 439/79 |

* cited by examiner

*Primary Examiner*—Javaid Nasri
(74) *Attorney, Agent, or Firm*—Wei Te Chung

(57) ABSTRACT

An electrical connector (100) includes an insulating housing having a pair of longitudinal side walls (11) and a pair of end walls (12) connecting the side walls thereby defining a receiving cavity therebetween. A plurality of terminal grooves (13) are defined in an inner side of the side wall and exposed to the receiving cavity. A plurality of terminals are received in said terminal grooves and comprise signal terminals and grounding terminals. At least one shell (3) covers on an outer side of the side wall and defines an upper side and a lower side. At least one grounding arm (33) is formed at the lower side of the shell and spaced to the lower side of the shell thereby forming a slot (333) therebetween. The at least one grounding arm (33) has a first portion (331) abutting against the side wall and a second portion (332) mechanically and electrically contacting with the grounding terminal.

4 Claims, 4 Drawing Sheets

ELECTRICAL CONNECTOR HAVING FLEXIBLY AND STEADILY ENGAGEMENT BETWEEN METALLIC SHELLS AND GROUNDING TERMINALS

BACKGROUND OF THE INVENTION

1. Field of the Invention

The present invention relates to an electrical connector, and particularly to a board-to-board connector having a metallic shell thereon.

2. Description of the Related Art

U.S. Pat. No. 5,915,976 issued to McHugh on Jun. 29, 1999, discloses a board-to-board connector. The connector has an insulating housing mounted with a plurality of terminals thereon and a metallic shell covering on the housing. The shell is in a plate like shape and forms a plurality of contacting arms arranged at intervals along a longitudinal edge of the shell and extending perpendicularly from the longitudinal edge. The insulating housing defines a plurality of receiving grooves arranged in two rows and running through a mounting face of the housing, and a few of which are used for receiving grounding terminals. The contacting arms of the shell project into the receiving grooves to mechanically and electrically contact with the grounding terminals so as to realize grounding function.

As the receiving grooves are arranged at edges of mounting face of the housing and the shell is covering on a side wall adjacent to the mounting face, therefore the contacting arms must be formed in a short and small size to enter into the receiving groove, thereby the contacting arms can not have enough flexibility and may not keep steadily contacting between the metallic shell and the grounding terminals. Hence, a new design which can solve the problem is required.

SUMMARY OF THE INVENTION

Accordingly, an object of the present invention is to provide an electrical connector with flexibly and steadily engagement between metallic shells and grounding terminals.

In order to achieve the object set forth, an electrical connector includes an insulating housing having a pair of longitudinal side walls and a pair of end walls connecting the side walls thereby defining a receiving cavity therebetween, a plurality of terminal grooves defining in an inner side of the side wall and exposed to the receiving cavity; a plurality of terminals received in said terminal grooves and comprising signal terminals and grounding terminals; and at least one shell covering on an outer side of the side wall and defining an upper side and a lower side, at least one grounding arm being formed at the lower side of the shell and spaced to the lower side of the shell thereby forming a slot therebetween, the at least one grounding arm having a first portion abutting against the side wall and a second portion mechanically and electrically contacting with the grounding terminal.

Other objects, advantages and novel features of the invention will become more apparent from the following detailed description of the present embodiment when taken in conjunction with the accompanying drawings.

DETAILED DESCRIPTION OF THE INVENTION

Figure 1:
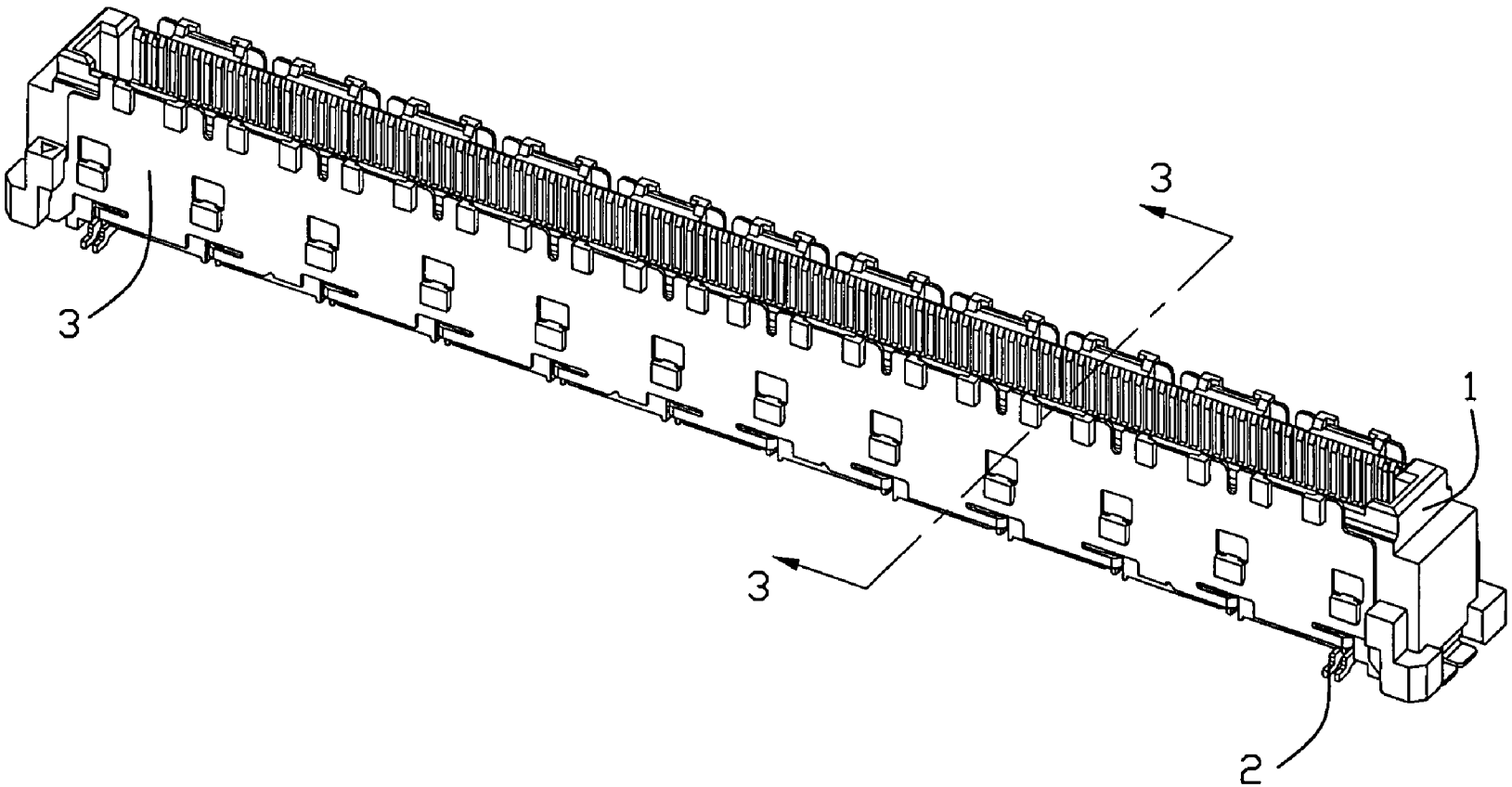
FIG. 1 is a perspective view of an electrical connector in accordance with the present invention.
Figure 2:
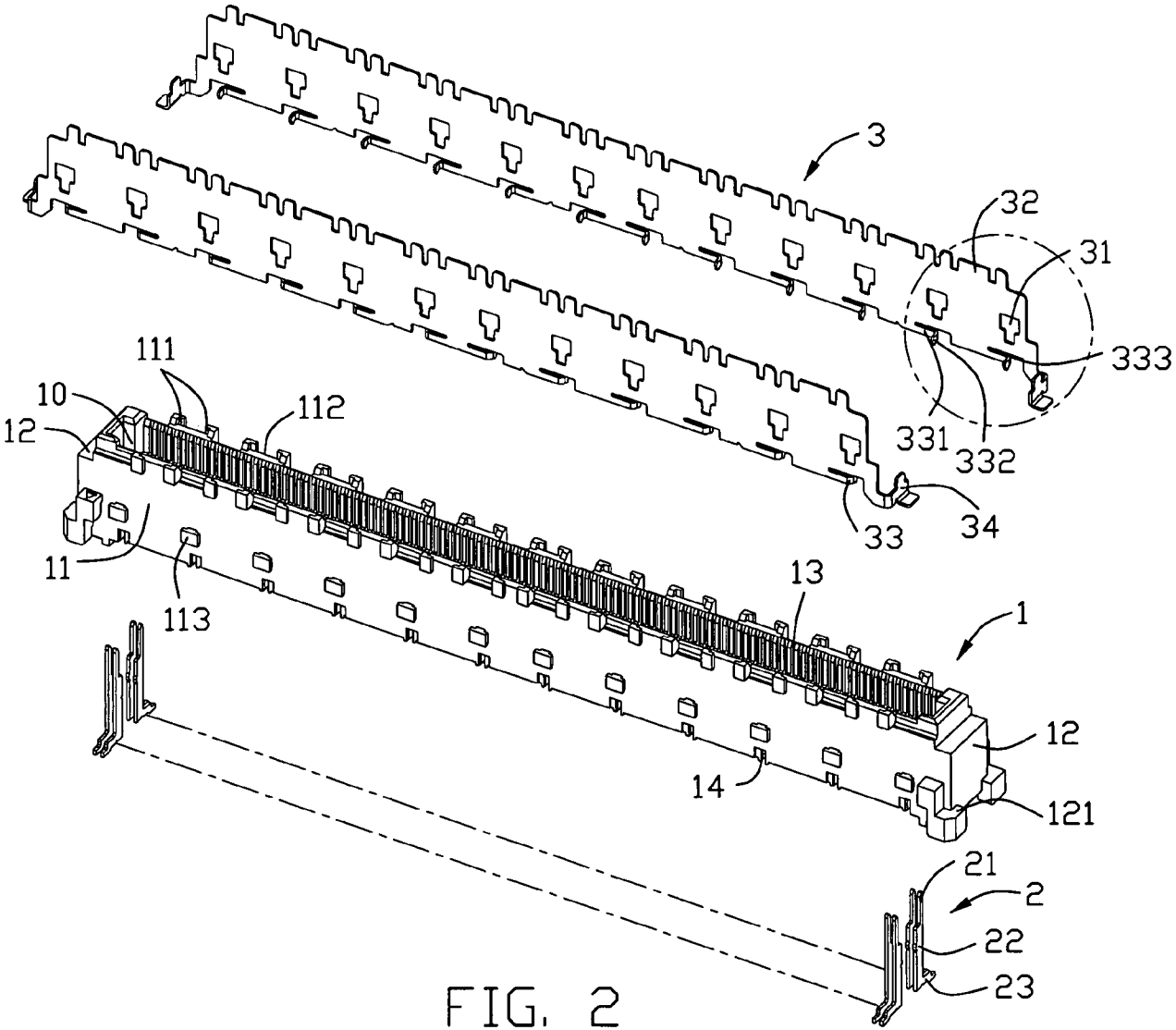
FIG. 2 is an exploded perspective view of the electrical connector shown in FIG. 1.

Reference will now be made to the drawing figures to describe a preferred embodiment of the present invention in detail. Referring to FIGS. 1 and 2, an electrical connector in accordance with the present invention comprises an insulating housing 1, a plurality of terminals 2 mounted on the insulating housing and a pair of shells 3 covering on opposite sides of the housing.

Figure 3:
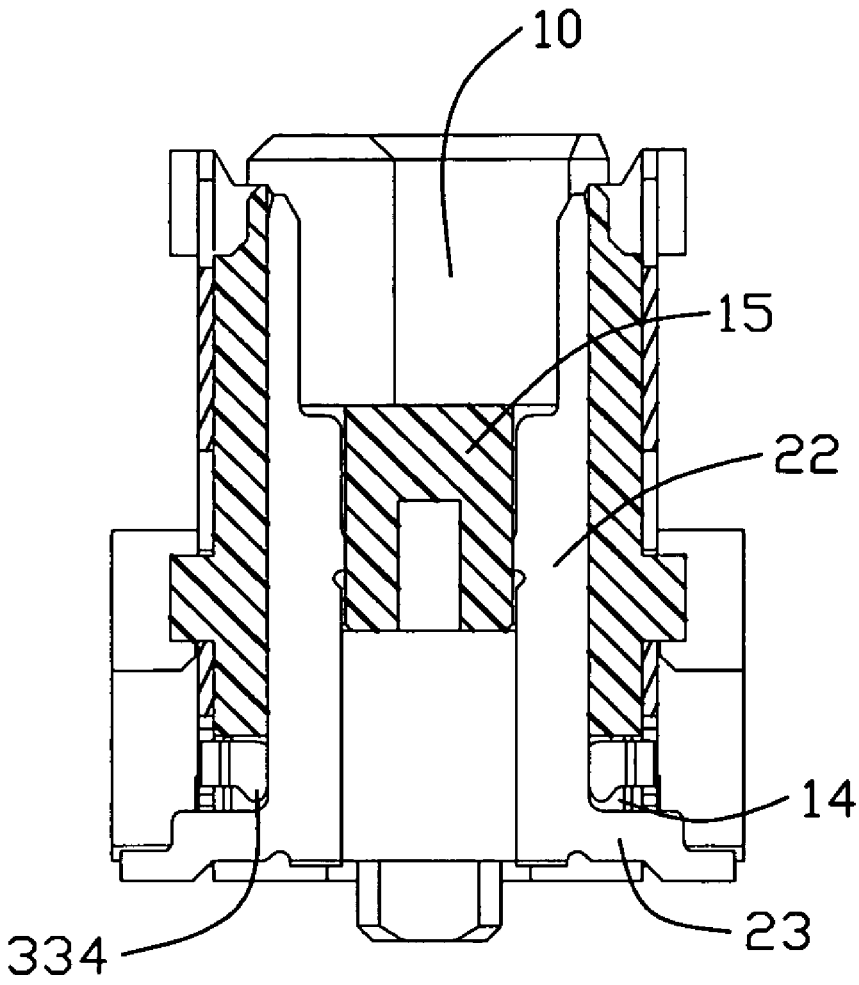
FIG. 3 is a cross sectional view of the electrical connector along line 3-3 shown in FIG. 1.

Referring to FIGS. 2 and 3, the insulating housing 1 comprises a pair of longitudinal side walls 11 and a pair of end walls 12 connecting the side walls, thereby defining a receiving cavity 10 therebetween for receiving a mating connector. An extending portion 15 protrudes upwardly from a bottom face of the receiving cavity 10. Two rows of terminal grooves 13 staggered with each other are respectively defined in inner sides of the side walls 11. A plurality of protrusions 111 are respectively formed at upper edge of an outer side of each side wall 11 and a slot 112 is defined between every two protrusions. A plurality of apertures 14 are respectively formed at lower edge of the outer side of each side wall 11 and communicate with the terminal grooves 13, and distance between adjacent apertures 14 are larger than that of the terminals grooves 13. A plurality of blocks 113 set in a line is formed on the outer side of each side wall 11 between the protrusions 111 and the apertures 14 in a longitudinal direction. A pair of passageways 121 are respectively defined at opposite sides of the end walls 12.

The terminals 2 include signal terminals and grounding terminals, which two are made in the same configuration, and the grounding terminals are received in the grooves 13 communicating with the apertures 14. Each terminal 2 comprises a retention portion 22 secured in the groove 13, a contacting portion 21 extending from one end of the retention portion 22 and a solder portion 23 extending from the other end of the retention portion 22 and projecting out of the insulating housing for mounting onto a printed circuit board.

Each shell 3 covers an outer face of the side wall 11 of the insulating housing and defines an upper side and a lower side. A plurality of flakes 32 are formed at the upper side of the shell and inserted into the slot 112 on the insulating housing 1. A pair of locking arms 34 are formed at opposite ends of the shell and exposed in the passageway 121 and locking with the insulating housing 1. A plurality of openings 31 are defined in a middle portion of the shell 3 for receiving the corresponding blocks 113. A plurality of grounding arms 33 are formed at the lower side of the shell and extending in the longitudinal direction.

Figure 4:
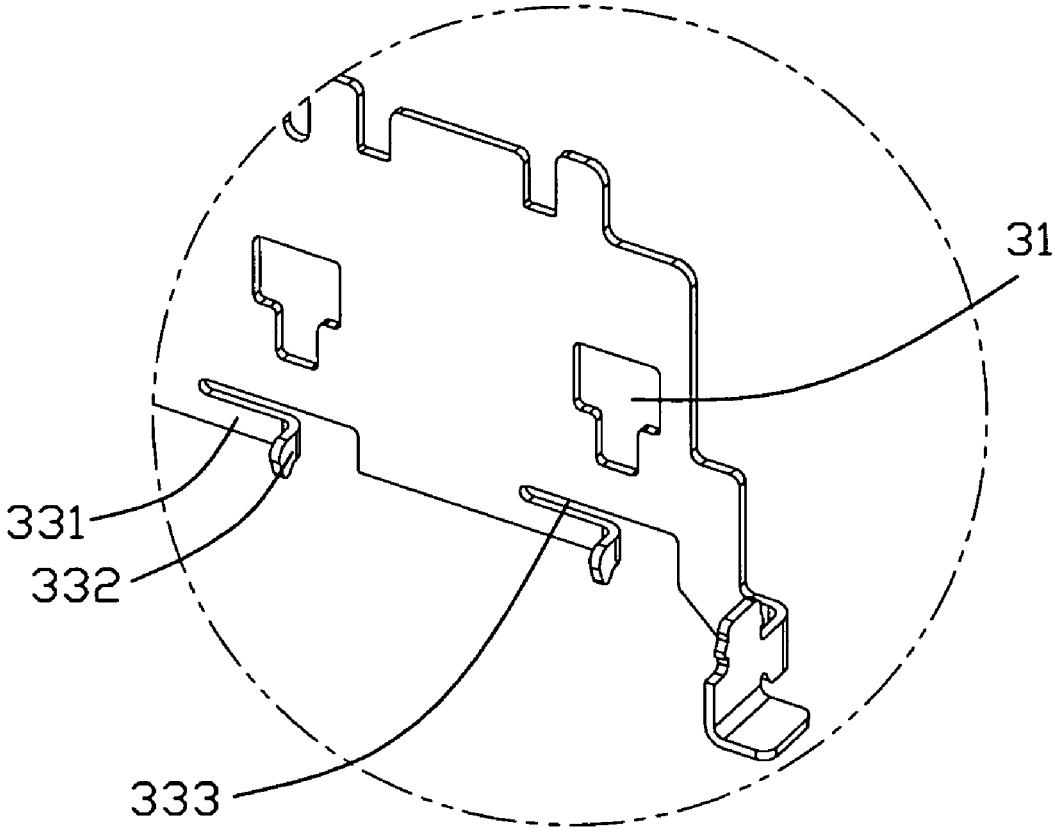
FIG. 4 is a partly amplified view of the electrical connector as circled in FIG. 2.

Referring to FIGS. 3 and 4, the grounding arms 33 are divided into two groups from a middle portion of the lower side of the shell and the two groups extend reversely. Each grounding arm 33 is formed by cutting off a lengthwise piece at the lower side of the shell along the longitudinal direction, therefore a slot 333 is defined between the grounding arm 33 and the lower side of the shell. The grounding arm 33 comprises a first portion 331 parallel to the slot 333 and a second portion 332 projecting upwardly from the distal end of the first portion 331. The second portion 332 is perpendicular to the first portion 331 in this embodiment and defines a curved portion 334 in the free end thereof. The second portion 332 is straightly inserted into the aperture 14 and abutting against a top of the solder portion 23 of the terminal 2 so as to prevent the shell 3 moving downwardly. As the terminal 2, which is received in the groove 13 corresponding with the aperture 14, is a grounding terminal, the shell 3 can realize the grounding function by the grounding arm 33 contacting with the grounding terminal 2.

As the first portion 331 is spaced to the lower side of the shell and runs in the longitudinal direction, the first portion 331 can be configured in a lengthwise shape so as to provide enough flexibility to ensure the second portion 332 having a large movement. The second portion 332 can get a large movement from the first portion, therefore the engagement between the second portion 332 and the solder portion 23 of the terminal 2 can be strengthened. More, only the second portion 332 of the grounding arm 33 is inserted into the aperture 14 in a direction perpendicular to the side wall 11 and the flexibility of the grounding arm 33 comes from the first portion 331 parallel to the side wall 11, therefore the grounding arm 33 will not increase the thickness of the side wall 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising: an insulating housing having a pair of longitudinal side walls and a pair of end walls connecting the side walls thereby defining a receiving cavity there between, a plurality of terminal grooves defining in an inner side of the side wall and exposed to the receiving cavity; a plurality of terminals received in said terminal grooves and comprising signal terminals and grounding terminals; and at least one shell covering on an outer side of the side wall and defining an upper side and a lower side, at least one grounding arm being formed at the lower side of the shell and spaced to the lower side of the shell thereby forming a slot there between, the at least one grounding arm having a first portion abutting against the side wall and a second portion mechanically and electrically contacting with the grounding terminal; wherein the second portion perpendicularly extends from an end of the first portion; wherein the second portion has a curved portion in a free end, the curved portion abuts against the grounding terminal; wherein each terminal has a retention portion secured in said terminal groove and a solder portion extending out of the housing, and the curved portion abuts against the solder portion; wherein the side wall defines at least one aperture adjacent to the solder portion of grounding terminal and the second portion of the grounding arm projects into the aperture to contact with the grounding terminal; wherein the at least one grounding arm comprises a plurality of grounding arms divided into two groups of plurality of grounding arms, first group and second group of plurality of grounding arms, the first group of plurality of grounding arms extends reversely to the second group of plurality of grounding arms.

2. The electrical connector as claimed in claim 1, wherein the shell defines a pair of locking arms at opposite ends to insert into corresponding passageways defined at the end walls.

3. An electrical connector comprising: an insulating housing having a pair of side walls extending in a longitudinal direction and connected by a pair of end walls; a plurality of terminals comprising signal terminals and grounding terminals mounted in the side walls; and at least one shell covering on the side wall and forming a plurality of grounding arms at a longitudinal edge thereof, said grounding arms being spaced to the longitudinal edge and having a first portion extending in the longitudinal direction and a second portion bending from a free end of the first portion to contact with the grounding terminal; wherein a plurality of apertures are defined on a lower side of the side wall to allow the second portions of the grounding arms to go through and abut against the grounding terminals; wherein the plurality of grounding arms are divided into two groups of plurality of grounding arms, first group and second group of plurality of grounding arms, the first group of plurality of grounding arms extends reversely to the second group of plurality of grounding arms.

4. The electrical connector as described in claim 3, wherein the first portion of the grounding arm abuts against the side wall and the second portion perpendicular extends from one end of the first portion.

* * * * *